United States Patent [19]

Hütter

[11] 4,262,862

[45] Apr. 21, 1981

[54] APPARATUS FOR CHANGING THE WING POSITIONS OF SWINGABLE WINGS OF A MISSILE

[75] Inventor: Horst Hütter, Tegernsee, Fed. Rep. of Germany

[73] Assignee: Messerschmitt-Bölkow-Blohm Gesellschaft mit beschraänkter Haftung, Fed. Rep. of Germany

[21] Appl. No.: 12,490

[22] Filed: Feb. 15, 1979

[30] Foreign Application Priority Data

Feb. 18, 1978 [DE] Fed. Rep. of Germany ... 7804927[U]

[51] Int. Cl.[3] ..... F42B 13/32

[52] U.S. Cl. ..... 244/3.29; 102/4

[58] Field of Search ..... 102/4; 244/3.27, 3.28, 244/3.29

[56] References Cited

U.S. PATENT DOCUMENTS

| | | | |
|---|---|---|---|
| 1,448,166 | 3/1923 | Strong | 244/3.29 |
| 1,879,840 | 9/1932 | Brandt | 244/3.29 X |
| 3,188,958 | 6/1965 | Burke et al. | 244/3.29 X |
| 3,289,587 | 12/1966 | Donnelly et al. | 244/3.29 X |
| 3,350,984 | 11/1967 | Neuman et al. | 244/3.29 X |
| 3,695,177 | 10/1972 | Chakoian et al. | 102/4 |
| 3,857,338 | 12/1974 | Bucklisch | 102/4 |

FOREIGN PATENT DOCUMENTS

| | | | |
|---|---|---|---|
| 1488187 | 6/1967 | France | 244/3.29 |

*Primary Examiner*—Peter A. Nelson
*Attorney, Agent, or Firm*—McGlew and Tuttle

[57] ABSTRACT

An apparatus for changing the wing position of swingable wings of a missile, comprises, a piston which is movable linearly in a fluid pressure cylinder under the control of a fluid pressure, which is connected through a cable to each wing. The pivot for the wing includes recesses which are engaged by detent members in both an inwardly swung-in position and an outwardly swung position.

6 Claims, 1 Drawing Figure

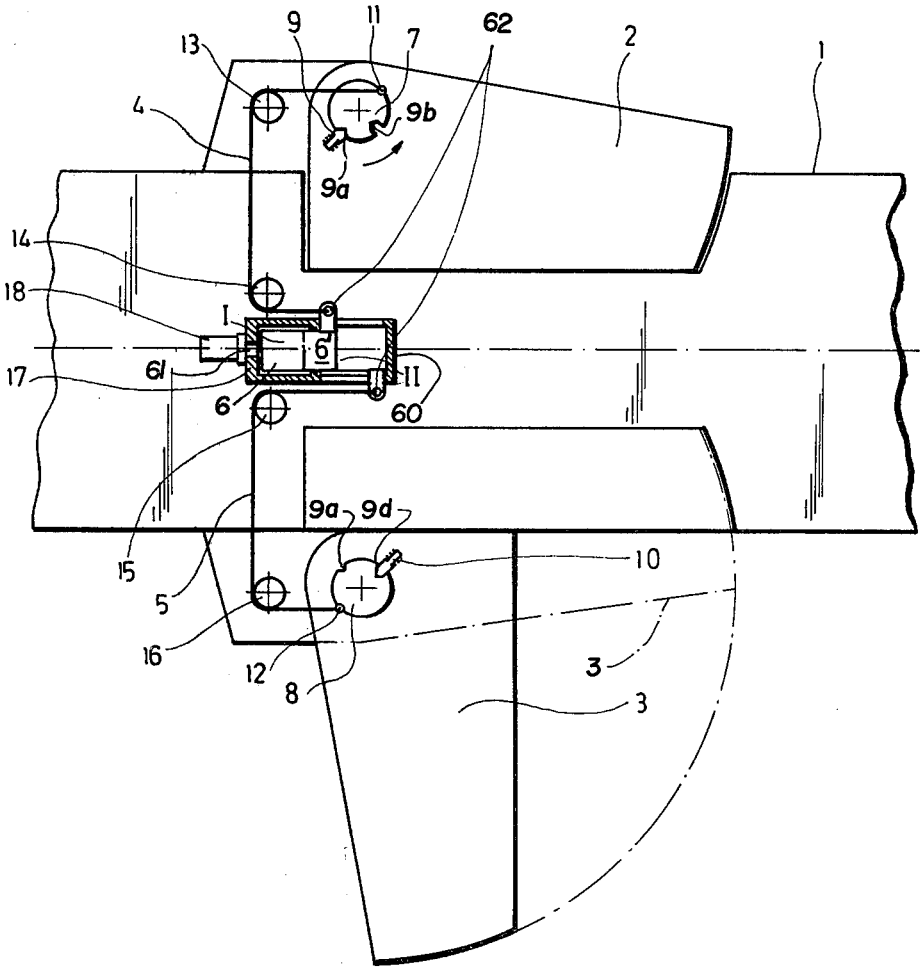
9
11
7
62
2
1
13
4
9b
9a
14
18
I
6
17
61
II
6
60
15
9a
9d
10
5
16
12
8
3
3

APPARATUS FOR CHANGING THE WING POSITIONS OF SWINGABLE WINGS OF A MISSILE

FIELD AND BACKGROUND OF THE INVENTION

This invention relates to the construction of missiles in general and, in particular, to a new and useful missile having wings which are pivotal on a missile body and to a mechanism for pivoting the wings which includes a linearly movable piston connected to the wings by a cable.

DESCRIPTION OF THE PRIOR ART

The invention is particularly concerned with a device for the simultaneous swinging-out of swing-wings for missiles with a large diameter, for example more than 15 cm. In a known device of this type (see German Patent Disclosure DOS No. 2,264,338), the swing-wings are hinged on a ring which is mounted for displacement on a cylindrical part of a rocket engine. The swing-wings are stayed synchronously by a rearwardly directed pressure on the ring. In missiles with a large diameter, such a device is too elaborate and too heavy.

SUMMARY OF THE INVENTION

The present invention provides a simple and light-weight device which permits the simultaneous swinging-out of two or more swing-wings in a missile with a large diameter.

The solution of this problem consists in connecting each swing-wing with one linearly movable piston by a cable line. Cable lines have the advantage that they can be heavily loaded and still have a relatively low weight. In addition, a cable line permits a very simple swing mechanism for the swing-wings.

The apparatus includes detents or catches associated with each wing pivot to effect a uniform positioning of the swing-wings in both a swung-in position and in a swung-out position. The detents also relieve the cable lines when the swing-wings are swung out.

The operation of the linear piston by a pressure gas source, particularly, a gas generator supplying a fluid-pressure operated piston and cylinder combination, is particularly easy and problem-free. The cylinder of the piston preferably remains admitted with pressure gas after ignition of the gas generator, so that the swing-wings are held, in addition to the detents, by the cable line in the swung-out position.

Accordingly, an object of the invention is to provide a missile construction which includes a missile body having wings which are pivotally mounted on the body and which are movable between a swung-in position in which they are retracted at least partly within the body to a swung-out position extending outwardly from the body, and which includes a piston which is movable linearly under the control of the fluid pressure and a connecting cable connected between the piston and each wing or its associated pivot shaft to pivot the wing in accordance with the movement of the piston.

A further object of the invention is to provide an apparatus for changing the wing positions of swingable wings of a missile which is simple in design, rugged in construction and economical to manufacture.

The various features of novelty which characterize the invention are pointed out with particularity in the claims annexed to and forming a part of this disclosure.

For a better understanding of the invention its operating advantages and specific objects attained by its uses, reference is made to the accompanying drawing and descriptive matter in which a preferred embodiment of the invention is illustrated.

BRIEF DESCRIPTION OF THE DRAWING

In the drawing:

The only FIGURE of the drawing is a partial schematic, sectional view of a missile body having apparatus for shifting a wing structure thereof, constructed in accordance with the invention.

DESCRIPTION OF THE PREFERRED EMBODIMENT

Referring to the drawing in particular, the invention embodied therein, comprises an aircraft or missile, having a fuselage or body 1, with wings 2 and 3 which are pivotal on the body and are carried by respective axle members or shaft pivots 7 and 8 at diametrically opposite sides of the body.

In accordance with the invention, wings 2 and 3 may each be pivoted by either rotating it about its associated axle 7 or 8 or rotating the axle 7 or 8 with the wing to effect the pivoting between a swung-in position indicated by the wing 2 in solid lines in the FIGURE or a swung-out position indicated by the solid line view of the wing 3. This pivoting is accomplished in accordance with the invention by a fluid pressure operated piston and cylinder combination which includes a piston 6 movable in a cylinder 60 under the control of a fluid pressure which is admitted through a passage 61 of the cylinder. In the position indicated, piston 6 assumes an inward position designated I in which side pieces 62 are positioned as shown in the top of the cylinder 60 and in which the wing structures 2 and 3 are arranged in a folded-in or swung-in position, as shown in respect to the wing 2 in solid lines and the wing 3 in dotted lines. Piston 6 is connected through pieces 62 to cables 4 which are guided over inner guide rolls 14 or 15 and outer guide rolls 13 or 16 and have its opposite ends connected at 11 to the wing 2 or at 12 to wing 3. In the position II, shown in the drawing, which is indicated in respect to the control of the wing 3 to the swung-out position, piston 6 is moved rearwardly in the associated cylinder 60 by fluid pressure admitted through the opening 61. This causes the cable 5 to pull the wing 3 which is rotating on its associated pivot shaft 8 to an outwardly extended or swung-out position, as shown in solid lines with respect to the wing 3. The wings are usually moved in synchrony, that is, both wings 2 and 3 are moved outwardly at the same time, but the drawing shows the respectively inwardly swung end position and outwardly swung end position of the wings 2 and 3.

In accordance with another feature of the invention, the pressure for pressurizing the cylinder 60 is supplied from a gas generator 18 which is ignited to maintain a pressure on the piston, for example, in the swung-out position. Alternatively, or simultaneously, detend means are associated with the wings 2 or 3 or their associated pivots 7 and 8 and they comprise a recess **9*a* which is circumferentially spaced away from a recess 9*b* on the associated pivot shafts 7 and 8. The upper part of the FIGURE shows a detend 9 engaged in recess 9*a* when the wing 2 is in a swung-in position. Detend 10 is shown in engagement in the recess 9*b* to hold the wing 3** in the swung-out position.

While a specific embodiment of the invention has been shown and described in detail to illustrate the application of the principles of the invention, it will be understood that the invention may be embodied otherwise without departing from such principles.

I claim:

1. A missile, comprising a missile body having wings, which are pivotally mounted on said body and being pivotable between an inwardly swung position in which the wings extend inwardly of the body and an outwardly swung position in which the wings extend outwardly from the body, a fluid pressure operated piston and cylinder mounted on said body and having a piston movable in said cylinder, and cables connected between each of said wings and said piston being movable with said piston to swing said wings outwardly, said piston and cylinder combination being centrally positioned between said wings, including cables connected to each of said wings, and means for guiding said cables between said piston and said wings so that the wings move outwardly and inwardly by linear movement of said pistons.

2. A missile, as claimed in claim 1, including detend means associated with each of the pivotal mounting of said wings on said body for biasing said wings in both a swung-in end position and a swung-out end position.

3. A missile, as claimed in claim 1, including a pressure gas source connected to said cylinder and means for supplying pressure gas to said cylinder to move said piston for swinging said wings.

4. A missile, as claimed in claim 3, wherein said pressure gas source comprises a gas generator connected to said cylinder.

5. A missile, as claimed in claim 2, including pivot axles connected to said missile body, each of said wings are movably mounted on said axles, each of said axle having a recess therein, each of said wings having a detent engageable with said recess to bias said wing with the associated axle in a selected position.

6. A missile, as claimed in claim 1, wherein said pivot axle of each of said wings includes at least two circumferentially spaced recesses and each of said wings includes a detent engageable with the respective recesses in both a fully swung-in position of the wing and a swung-out position of the wing to bias the wing in one of these positions.

* * * * *